US007097389B1

(12) United States Patent
Skidmore et al.

(10) Patent No.: US 7,097,389 B1
(45) Date of Patent: Aug. 29, 2006

(54) FORKLIFT MOVABLE CRIBBING COLUMN

(75) Inventors: David A. Skidmore, Bluefield, VA (US); Thomas H. Harris, Honaker, VA (US)

(73) Assignee: E. Dillon & Company, Swords Creek, VA (US)

( * ) Notice: Subject to any disclaimer, the term of this patent is extended or adjusted under 35 U.S.C. 154(b) by 0 days.

(21) Appl. No.: 11/140,886

(22) Filed: May 31, 2005

(51) Int. Cl.
*E21D 15/00* (2006.01)

(52) U.S. Cl. ..... 405/288; 405/272; 405/273; 299/11

(58) Field of Classification Search ..... 405/288, 405/272, 273, 290; 299/11, 12
See application file for complete search history.

(56) References Cited

U.S. PATENT DOCUMENTS 4,195,111 A * 3/1980 Rautenbach ..... 405/288
4,565,469 A * 1/1986 Chlumecky ..... 405/288
5,143,484 A * 9/1992 Deul ..... 405/288
5,342,150 A * 8/1994 Kitchen ..... 405/288
5,439,325 A * 8/1995 Kitchen ..... 405/288
6,729,806 B1 * 5/2004 Knight ..... 405/288

* cited by examiner

*Primary Examiner*—Frederick L. Lagman

(57) ABSTRACT

A prefabricated cribbing column for supporting a mine roof. The column includes a plurality of concrete cribbing elements the majority of which are interleaved with load transfer disks. Two of the cribbing elements are interleaved with a handle element. The column assembly of cribbing elements, load transfer disks, and handle element are secured together in an integral unit by a steel strap. The handle element extends substantially beyond the outer periphery of the cribbing elements enabling access and lifting by a forklift or similar machinery. The handle element enables the integral column to be easily moved from one location to another. The cribbing elements are preferably constructed of steel fiber reinforced concrete. A column consisting of five cribbing elements has shown to be capable of supporting a load of 575 tons with a deflection of 2.5 inches or less.

19 Claims, 6 Drawing Sheets

FORKLIFT MOVABLE CRIBBING COLUMN

FIELD OF THE INVENTION

The present invention relates to cribbing for supporting a mine roof and more specifically to a cribbing column consisting of a column of concrete blocks separated by narrow disks of deformable material for preventing premature point loading at specific points of the various blocks that comprise the column.

BACKGROUND OF THE INVENTION

Underground cribbing is commonly used in mines for supporting a mine roof or the like. The cribbing is formed of cribbing elements such as wooden beams or concrete blocks, which are stacked from the mine floor to the mine roof in order to provide support for the roof.

Although many different types of cribbing elements have been proposed for the support of mine roofs, they are typically assembled in a similar manner in the mine. Typically, the cribbing elements are much smaller in height than the distance between the mine floor and the mine roof, and therefore a great many cribbing elements must be transported to the mines and then assembled at each location in which the roof needs to be supported.

Assembling the separate cribbing elements into a mine support is typically laborious and requires a significant amount of time. When stacked vertically, some common cribbing elements must have their outer perimeters in alignment. Other types include notches or other features that require interlocking of adjacent elements to keep them in alignment. Since the cribbing elements are typically much less in height than the clearance between the floor and roof, a significant amount of time and effort are expended at each separate roof support location.

An additional problem arises with cribbing elements constructed of concrete blocks. Typically, mine floors are not perfectly level. They may have slight slopes or may have uneven surfaces. This typically doesn't present a problem when the cribbing elements are constructed of an easily compressible material such as wood, as the wood elements will deform in the area of the high spot on the uneven surface. However, when using concrete block cribbing elements, the relatively uncompressible blocks may break on a high spot on the uneven surface.

Another problem arises with cribbing elements that are aligned along their outer peripheries. Since a large number of cribbing elements must be aligned laterally while building the vertical support, it is sometimes difficult to obtain a true lateral alignment of the elements. If one or more of the cribbing elements is out of lateral alignment, the entire surface of the misaligned cribbing element is not available to support the load, thereby increasing the specific loading per area on the cribbing element and possibly leading to premature failure of the roof support.

Therefore, as should be obvious by the above description, prior art mine roof supports constructed of separate cribbing elements can be improved.

OBJECTS AND ADVANTAGES

The present invention, a forklift movable cribbing column, therefore overcomes several disadvantages of the prior art by providing a cribbing column assembly including individual cribbing elements secured together into an integral column. A load transfer plate is included between each of the cribbing elements to distribute the supported load evenly to the next lower element. A handle arrangement is included with the cribbing column to enable easy lifting by a forklift or similar machine.

The integral cribbing column of the present invention provides several advantages, including a significant reduction of setup or assembly time, ease of transportation to the mine, and elimination of the possibility of lateral misalignment of the individual cribbing elements.

These, and other advantages will be apparent to a person skilled in the art by reading the attached description along with reference to the attached drawings.

SUMMARY OF THE INVENTION

A prefabricated cribbing column for supporting a mine roof. The column includes a plurality of concrete cribbing elements the majority of which are interleaved with load transfer disks. Two of the cribbing elements are interleaved with a handle element. The column assembly of cribbing elements, load transfer disks, and handle element are secured together in an integral unit by strapping material, such as steel or plastic straps. The handle element extends substantially beyond the outer periphery of the cribbing elements enabling access and lifting by a forklift or similar machinery. The handle element enables the integral column to be easily moved from one location to another as well as providing load transfer capabilities. The cribbing elements are preferably constructed of steel fiber reinforced concrete. A column consisting of five cribbing elements has shown to be capable of supporting a load of 575 tons with a deflection of 2.5 inches or less.

TABLE OF NOMENCLATURE

Figure 1:
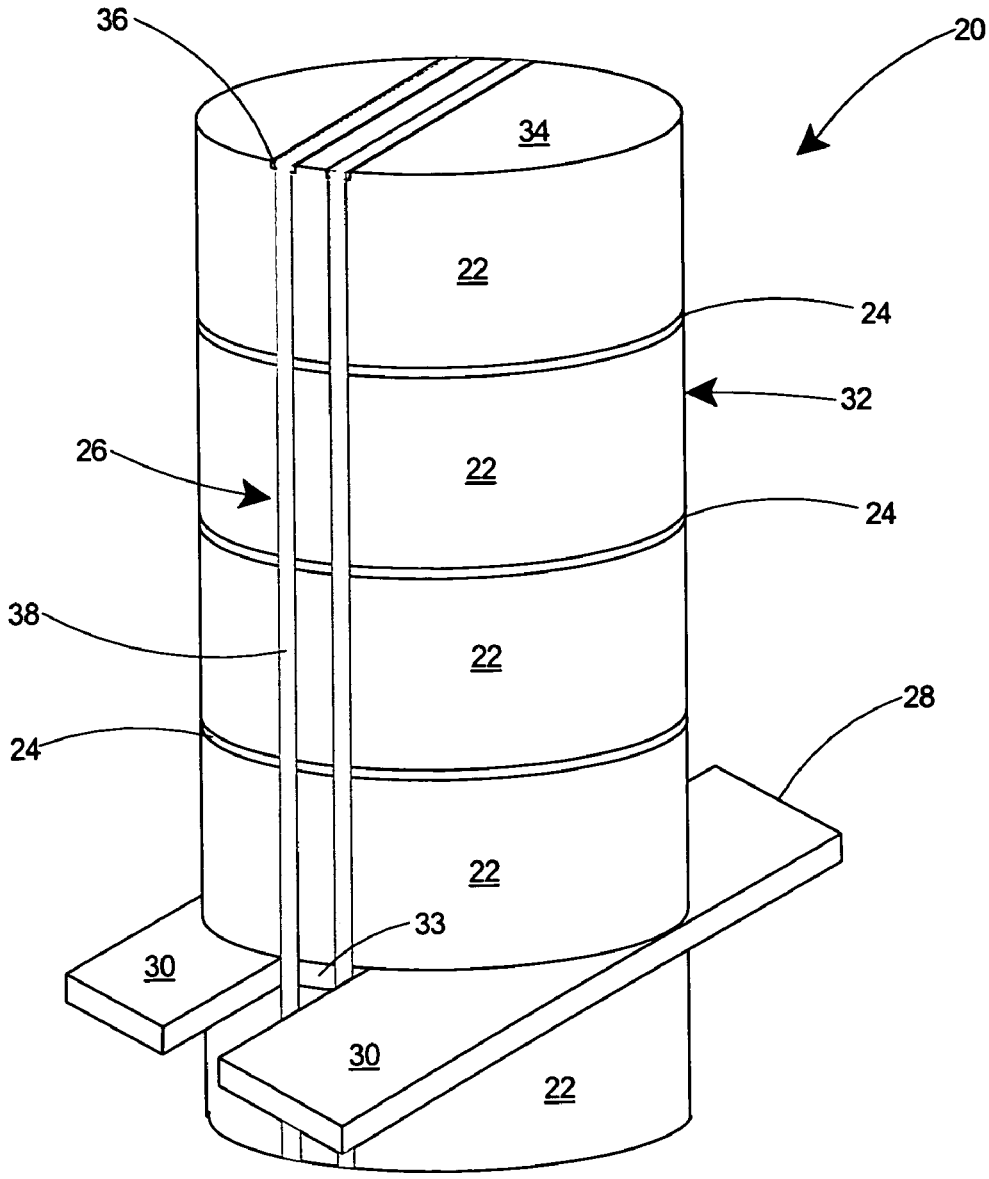
FIG. 1 is a perspective view of a preferred embodiment of a forklift movable cribbing column according to the present invention.

The following is a listing of part numbers used in the drawings along with a brief description:

| Part Number | Description |
|---|---|
| 20 | cribbing column, first embodiment |
| 22 | cribbing element |
| 22A | top cribbing element |

-continued

| Part Number | Description |
|---|---|
| 24 | load transfer plate |
| 26 | fastening arrangement |
| 28 | handle |
| 30 | handling member |
| 32 | outer periphery of cribbing element |
| 33 | spacer |
| 34 | top surface |
| 36 | notch |
| 37 | edge of cribbing element |
| 38 | metal strap or band |
| 40 | center hole |
| 42 | axial center of cribbing element |
| 44 | cribbing column, second embodiment |
| 44A | first or bottom cribbing column |
| 44B | second or top cribbing column |
| 46 | mine floor |
| 48 | mine ceiling |
| 50 | footprint member |
| 52 | cap member |
| 54 | filler member |
| 56 | roof support |
| D | diameter of cribbing element |
| H | height of cribbing element |

DETAILED DESCRIPTION

With reference to FIG. 1, there is shown a first embodiment of a forklift movable cribbing column 20 according to the present invention. The cribbing column is used to support a mine roof and includes a plurality of cribbing elements 22 arranged in a vertical stack. A handle 28 is secured to the cribbing column 20 and provides a means for lifting the column so it can be moved from one location to another. A load transfer plate 24 is interleaved between each of the cribbing elements 22 except where the handle 28 is inserted. A fastening arrangement 26 secures the cribbing elements 22 and the load transfer plates 24 together into an integral column 20. The handle 28 includes one or more elongated handling members 30 interleaved between two of the cribbing elements 22 and extending substantially beyond the outer periphery 32 of the cribbing elements 22 thereby making it easy to grasp the column by the handle 28 by a forklift or similar machine. Preferably the handle extends at least 6 inches beyond the outer periphery 32 of the cribbing elements 22 or column 20. A spacer 33 maintains spatial separation between the two elongated handling members and also enables load transfer between the cribbing elements it is interleaved between.

Figure 2:
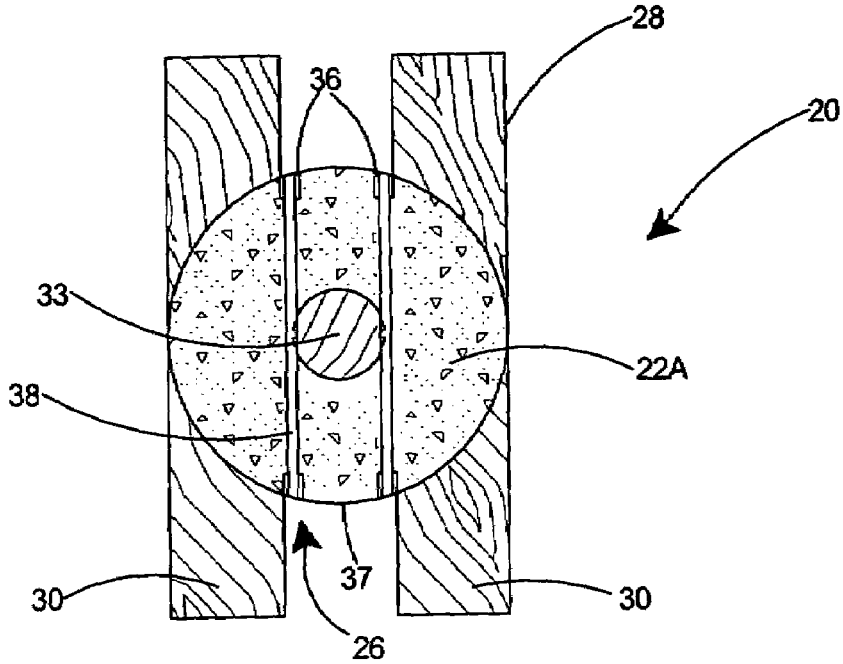
FIG. 2 is a top view of the cribbing column of FIG. 1.
Figure 3:
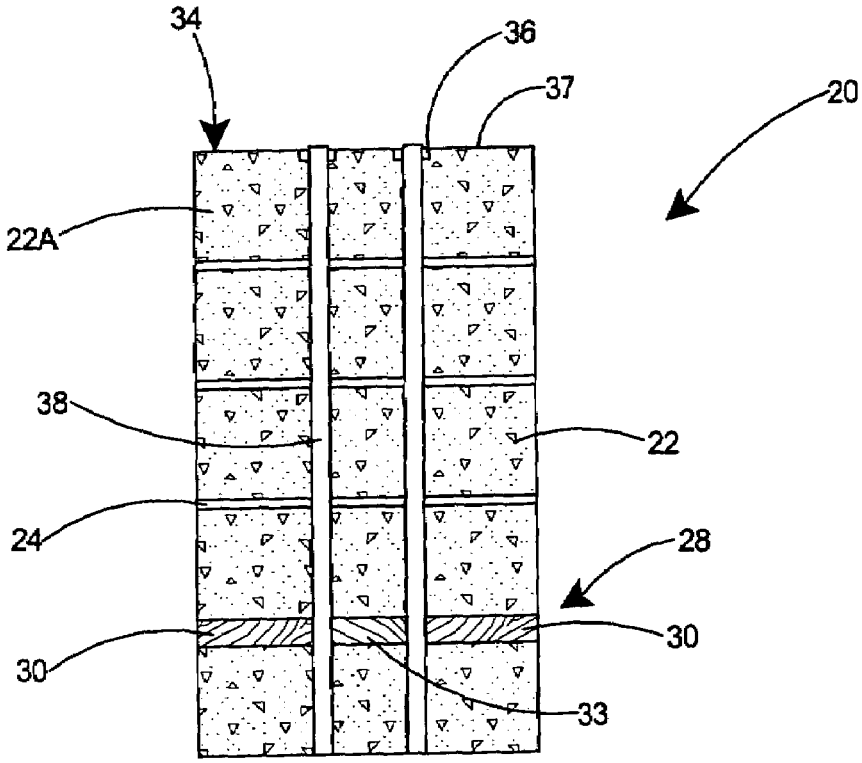
FIG. 3 is a side view of the cribbing column of FIG. 1.

With reference to FIGS. 2 and 3, the integral cribbing column 20 includes a top cribbing element 22A having a top surface 34 and one or more notches 36 in the top surface 34 at each edge 37 of the top cribbing element 22A. The notches 36 are located at each edge 37 of the top surface 34 but can also extend laterally across the entire top surface 34 of the top cribbing element 22A. The fastening arrangement 26 is disposed and tightened vertically around the column 20 thus securing the cribbing elements 22, load transfer plates 24, and handle 28 into an integral cribbing column 20. The fastening arrangement 26 is preferably one or more metal straps 38 that are each are disposed within one of the notches 36 in the top surface 34 of the top cribbing element 22A.

Figure 4:
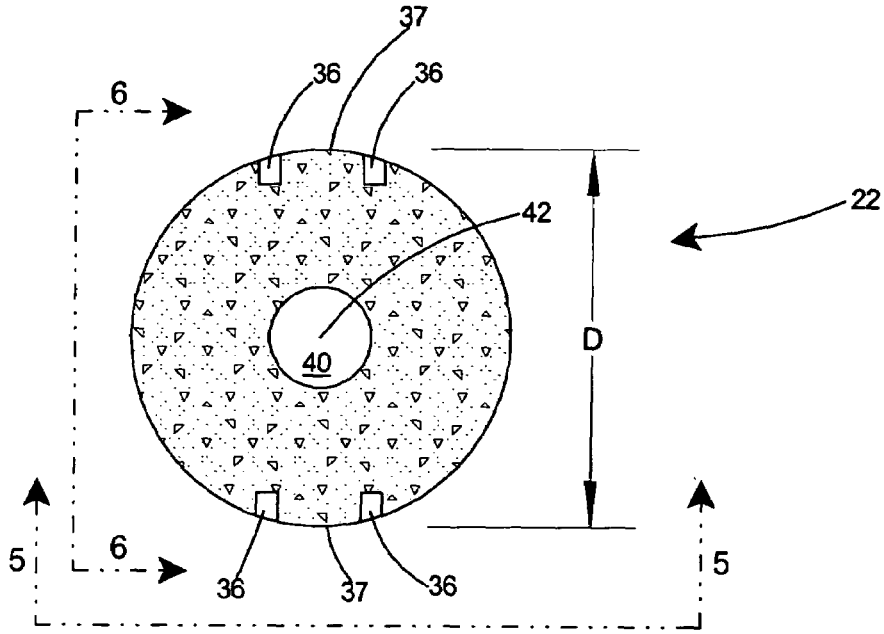
FIG. 4 is a top view of an concrete block used to construct the cribbing column of FIG. 1.
Figure 5:
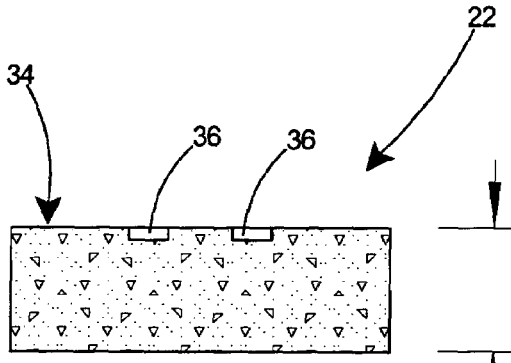
FIG. 5 is a side view of the concrete block taken along lines 5—5 of FIG. 4.
Figure 6:
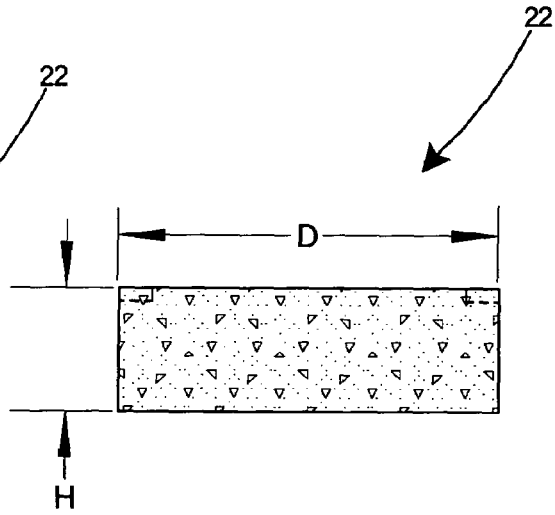
FIG. 6 is a side view of the concrete block taken along lines 6—6 of FIG. 4.

Referring to FIGS. 4–6, the cribbing elements 22 for constructing the cribbing column of the present invention may be of cylindrical, rectangular, or triangular shape. For purposes of explaining the present invention, the cribbing elements 22 shown herein are of cylindrical shape. The cribbing elements 22 are preferably constructed of concrete reinforced with steel fiber. The cylindrical-shaped cribbing elements 22 include a diameter D and a height H, with the diameter D preferably between 12 and 20 inches and the height H preferably between 5 and 9 inches. Furthermore, to lighten the weight of the individual cribbing elements 22, center holes 40 may be provided, preferably extending axially through each cribbing element 22. The center holes 40 are preferably between 3 and 7 inches in diameter. A most preferred embodiment of the cribbing elements 22 includes a diameter D of 17.62 inches, a height H of 7.25 inches, and a center hole 40 having a diameter of 4.88 inches.

With reference to FIGS. 4 and 5, the cribbing elements 22 include an axial center 42. The notches 36 preferably are two in number and each of the notches 36 are equidistant from the axial center 42 and preferably are on at least each edge 37 of the cribbing element 22.

Referring to FIG. 3, the load transfer plates 24 are preferably constructed of wood and are preferably have a thickness of between 0.125 and 0.250 inch. The notches 36 in the cribbing elements 22 preferably are between 0.125 and 0.5 inch in depth from the top surface 34 and furthermore are preferably between 0.625 and 0.687 inch wide. The metal strap 38 is preferably constructed of steel and is at least 0.5 inch wide. Preferably the handle 28 is capable of supporting a static load of at least 450 pounds.

Figure 7:
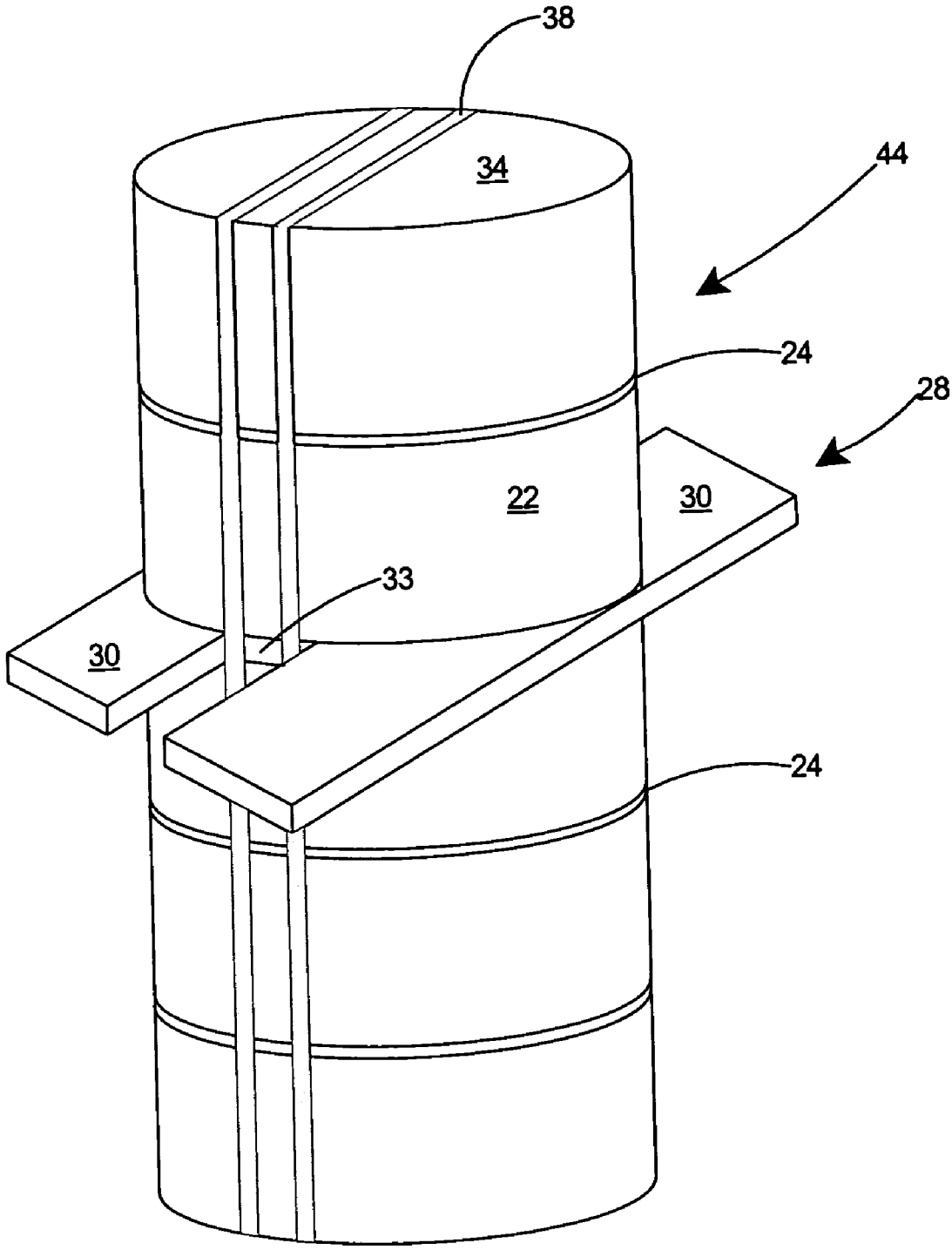
FIG. 7 is a perspective view of the concrete block of FIG. 4.

With reference to FIG. 7 there is shown a second and preferred embodiment of a forklift movable cribbing column 44 according to the present invention. The cribbing column 44 depicted in FIG. 7 includes a total of five cribbing elements 22, although cribbing columns having less or more cribbing elements could readily be constructed provide roof support in mines having various ceiling heights. For the cribbing column 44 of FIG. 7, the handle 28 is placed between the third and fourth cribbing elements, thereby giving the integral cribbing column 44 more stability and less chance of tipping over when pickup up and handled by a forklift.

The results of compression testing of three cribbing columns are given in Table 1 below. The cribbing columns 20 were configured as shown in FIG. 1, with a total of five cribbing elements 22. The tests were conducted on a Tinius Olsen $1.2\times10^6$ pound testing machine under NDT Control 217. Results of the compression testing showed the cribbing columns 20 capable of supporting a load of up to 1, 150,000 pounds with a total column deflection of 2.5 inches or less. It should be noted that the cribbing columns tested withstood the weight limit of the testing machine without failure. Therefore the cribbing columns described herein are capable of supporting a load of at least 1,150,000 pounds (575 tons).

TABLE 1

| Load (pounds) | Column 1 (deflection - inches) | Column 2 (deflection - inches) | Column 3 (deflection - inches) |
|---|---|---|---|
| 0 | 0 | 0 | 0 |
| 100,000 | ⅜ | ¼ | ⅜ |
| 200,000 | 1¼ | ¾ | ⅞ |
| 300,000 | 1⅝ | 1¼ | 1½ |
| 400,000 | 1⅞ | 1½ | 1⅞ |
| 500,000 | 2 | 1¾ | 2 |
| 600,000 | 2 | 1⅞ | 2 |
| 700,000 | 2⅛ | 1⅞ | 2 1/16 |
| 800,000 | 2¼ | 2 | 2⅛ |
| 900,000 | 2¼ | 2 1/16 | 2 3/16 |
| 1,000,000 | 2¼ | 2⅛ | 2¼ |
| 1,100,000 | 2⅜ | 2⅛ | 2¼ |
| 1,150,000 | 2½ | 2 3/16 | 2¼ |

Figure 9:
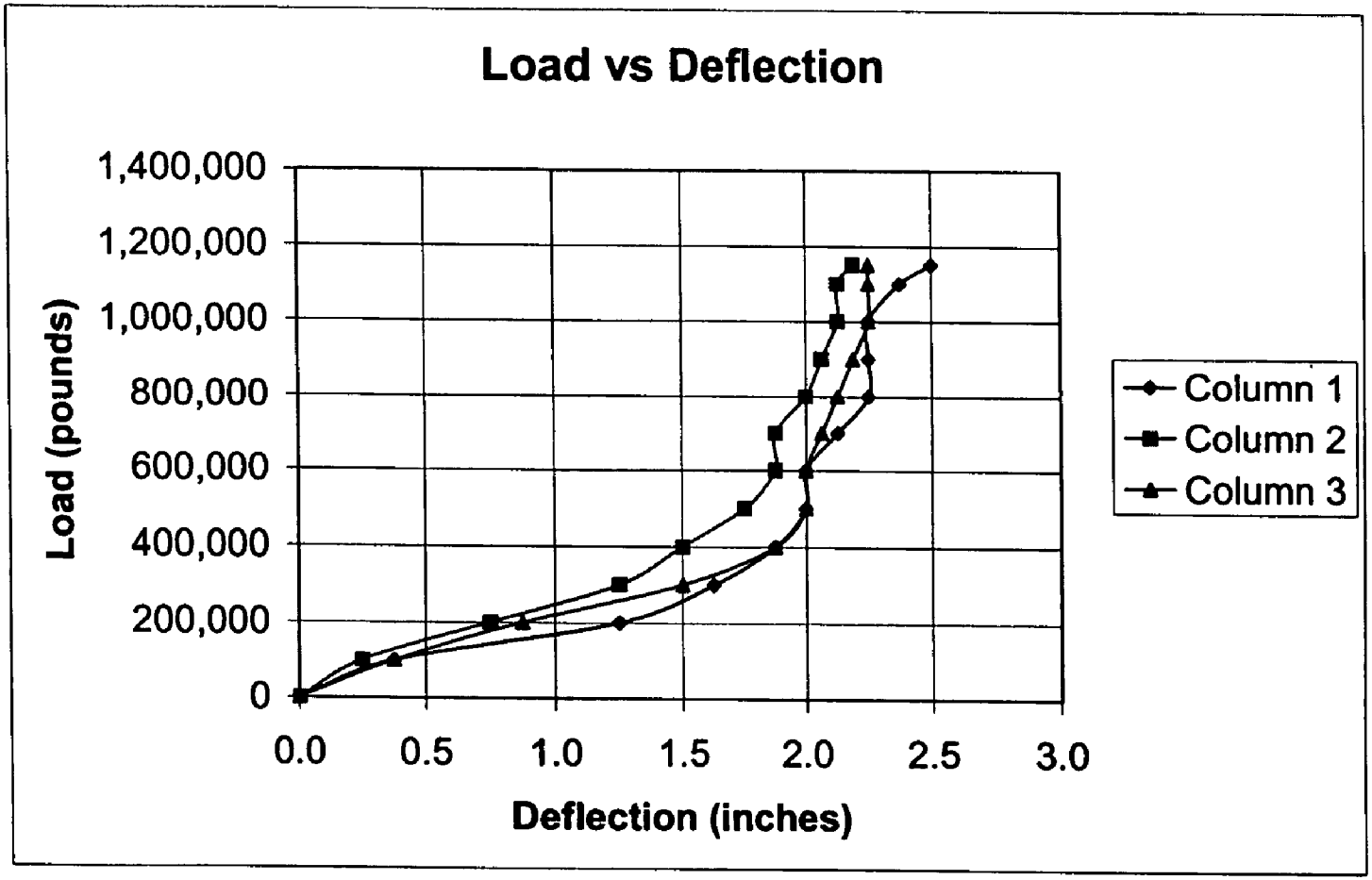
FIG. 9 is a graphical representation of load versus deflection for test results on a cribbing column according to the present invention.

With reference to FIG. 9, a graphical representation is shown of the compression test results listed in Table 1. As shown in the graph, each of the three cribbing columns supported a 1,150,000 pound load with a total column deflection of 2.5 inches or less.

For an understanding of the operation of the forklift movable cribbing column, the reader is referred to FIG. 7. For the cribbing column 44 of FIG. 7, the cribbing elements 22 have a nominal height of 7.25 inches, the load transfer plates 24 have a nominal thickness of 0.125 inch, and the handling members 30 have a nominal thickness of 1.5 inch. Thus a cribbing column having five cribbing elements 22 as shown in FIG. 7 would have a nominal height of 38.1 inches.

Figure 8:
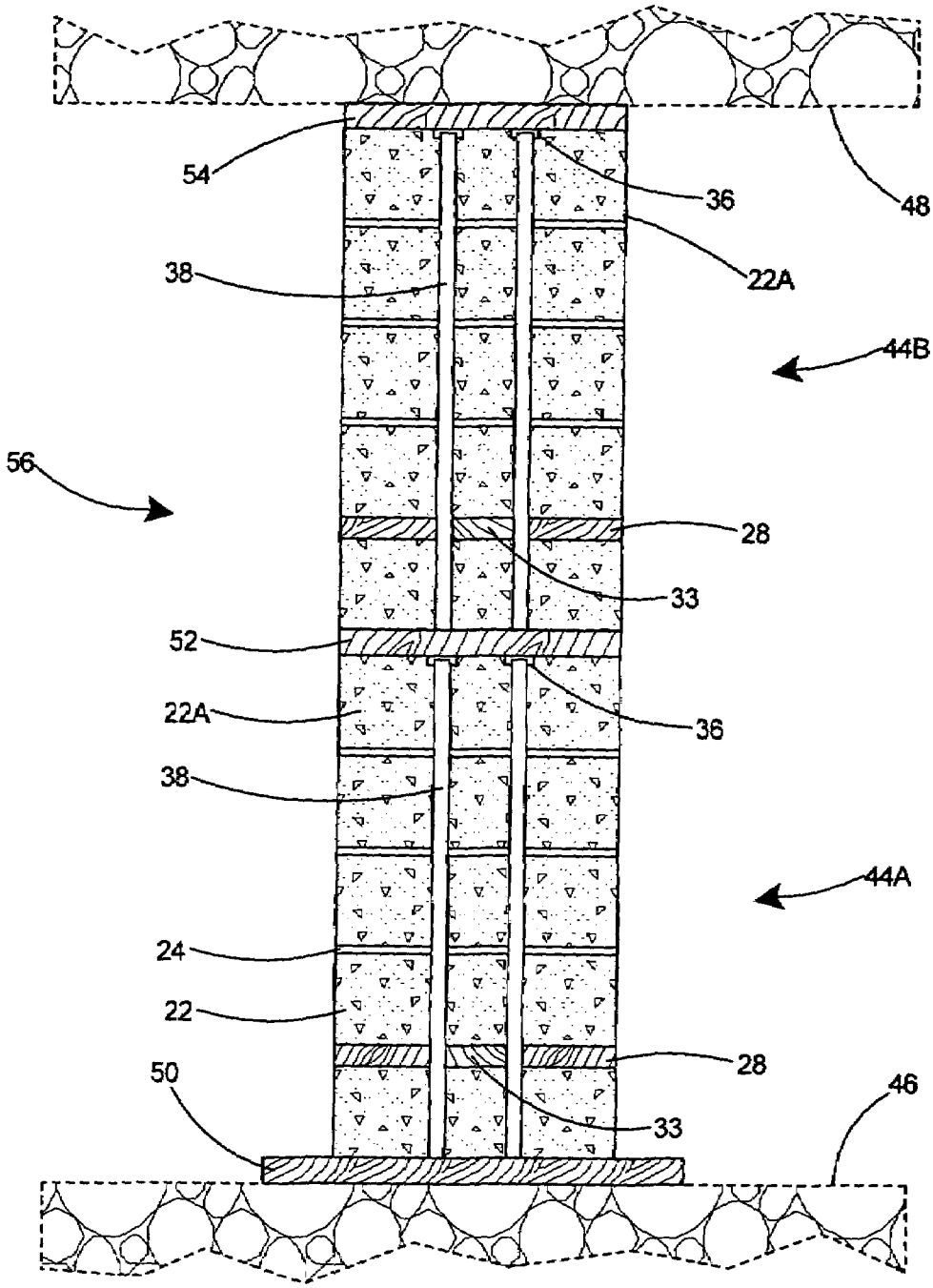
FIG. 8 is a side view of a two cribbing columns according to the present invention stacked vertically to support a mine roof.

As an example of operating the cribbing column of the present invention to support a roof, the reader is referred to FIG. 8. FIG. 8 depicts a mine having an 80-inch clearance between mine floor 46 and mine ceiling 48. A cribbing column according to the present invention is moved to the desired location where the roof needs to be shored. Typically a footprint member 50 is placed on the mine floor 46 to serve as a compressive member and provide an even base for the cribbing column. A first cribbing column 44A is then lifted by the handle 28 and transported to the shoring location by a forklift or the like. The first cribbing column 44A is then set on the footprint member 50. A cap member 52 is then placed on the first or bottom cribbing column 44A. A second column 44B is then placed on top of the cap member 52, which in turn rests on the bottom cribbing column 44A. The cap member 52 distributes the load evenly from the second or top cribbing column 44B to the bottom cribbing column 44A. The notches 36 in the top cribbing elements 22A prevent movement of the metal straps or bands 38. The open area between the top of the top cribbing column 44B and the mine ceiling 48 is then filled with a filler member 54 to complete the roof support 56. For a mine with a smaller clearance, such as 40 inches, one cribbing column of the type having five cribbing members would be sufficient to form a proper mine roof support. Naturally the cribbing column of the present invention could be constructed with less than 5 cribbing elements for even smaller mine clearances or with more than 5 cribbing elements for larger mine clearances. The footprint member 50, cap member 52, and filler member 54 are typically constructed of wood.

A cribbing column according to the present invention therefore provides a roof support that is easily transportable and vastly reduces installation time over prior art cribbing units. A cribbing column according to the present invention eliminates the possibility of lateral misalignment of individual cribbing elements, which can occur in columns constructed of prior art cribbing units and can cause a reduction in the load bearing area and lead to failure of the prior art column. The cribbing column of the present invention therefore provides a roof support that is easily aligned and provides the excellent compressive strength of steel fiber reinforced concrete blocks.

As the invention has been described, it will be apparent to those skilled in the art that the same may be varied in many ways without departing from the spirit and scope of the invention. Any and all such modifications are intended to be included within the scope of the appended claims.

What is claimed is:

1. A cribbing column for supporting a mine roof comprising:

a plurality of cribbing elements arranged in a vertical stack;

a load transfer plate interleaved between each of said cribbing elements;

a fastening arrangement to secure said cribbing elements and said load transfer plates together into an integral column; and a handle secured to said integral column.

2. The cribbing column of claim 1 wherein said cribbing elements include an outer periphery; and said handle includes an elongated member interleaved between two of said cribbing elements and extending substantially beyond said outer periphery of said cribbing elements.

3. The cribbing column of claim 2 wherein said handle extends at least 6 inches beyond said outer periphery.

4. The cribbing column of claim 1 wherein said handle is capable of supporting a static load of at least 450 pounds.

5. The cribbing column of claim 1 wherein said cribbing elements are constructed of steel fiber reinforced concrete.

6. The cribbing column of claim 1 wherein said cribbing elements are of cylindrical shape.

7. The cribbing column of claim 6 wherein said cribbing elements include a diameter and a height;

said diameter is between 12 and 20 inches; and said height is between 5 and 9 inches.

8. The cribbing column of claim 6 wherein said cribbing elements include center holes extending axially therethrough.

9. The cribbing column of claim 8 wherein said center holes are between 3 and 7 inches in diameter.

10. The cribbing column of claim 1 wherein said integral column includes a top cribbing element having a top surface and an edge; and one or more notches on said edge of said top surface of said top cribbing element.

11. The cribbing column of claim 10 including an axial center in said cribbing element;

said notches are four in number; and each of said notches are equidistant from said axial center.

12. The cribbing column of claim 1 wherein said load transfer plate is constructed of wood.

13. The cribbing column of claim 12 wherein said load transfer plate is between 0.125 and 0.250 inch in thickness.

14. The cribbing column of claim 10 wherein said notches are between 0.125 and 0.5 inch in depth from said top surface of said top cribbing element and said notches are between 0.625 and 0.687 inch wide.

15. The cribbing column of claim 10 wherein said fastening arrangement is a metal strap disposed and tightened vertically around said column.

16. The cribbing column of claim 15 wherein said metal strap is disposed within said notch in said top surface of said top cribbing element.

17. The cribbing column of claim 15 wherein said metal strap is constructed of steel and is at least 0.5 inch wide.

18. The cribbing column of claim 1 wherein said cribbing column includes a total of 5 cribbing elements; and said cribbing column is capable of supporting a load of 1,150,000 pounds with a total column deflection of 2.5 inches or less.

19. A method of supporting a mine roof with a cribbing column including:

providing one or more cribbing columns with each of said cribbing columns including a plurality of cribbing elements arranged in a vertical stack, a load transfer plate interleaved between each of said cribbing elements, a fastening arrangement securing said cribbing elements and said load transfer plates together into an integral column having a top and a bottom, and a handle secured to said integral column;

placing a footprint member in a desired mine roof support location;

lifting a first integral column by said handle;

placing said first integral column on said footprint member;

if the remaining space from said first integral column to said mine roof is greater than the length of said integral column:

placing a cap member on said top of said first integral column;

lifting a second integral column by said handle;

placing said second integral column on said cap member; and placing a filler member on said top of said second integral column to fill said remaining space;

if the remaining space from said first integral column to said mine roof is less than the length of said integral column:

placing a filler member on said top of said second integral column to fill said remaining space.

* * * * *